US009365408B2

(12) United States Patent
Tu

(10) Patent No.: US 9,365,408 B2
(45) Date of Patent: Jun. 14, 2016

(54) AUTO REFILL PERFUME ATOMIZER

(71) Applicant: Zhejiang JM Industry Co., LTD., Zhejiang (CN)

(72) Inventor: Xufeng Tu, Zhejiang (CN)

(73) Assignee: Zhejiang JM Industry Co., LTD., Yuyao (CN)

( * ) Notice: Subject to any disclaimer, the term of this patent is extended or adjusted under 35 U.S.C. 154(b) by 479 days.

(21) Appl. No.: 13/678,897

(22) Filed: Nov. 16, 2012

(65) Prior Publication Data

US 2014/0137983 A1 May 22, 2014

(51) Int. Cl.
*B05B 11/00* (2006.01)
*B67D 7/06* (2010.01)

(52) U.S. Cl.
CPC ..... *B67D 7/06* (2013.01); *B05B 11/0056* (2013.01); *B05B 11/3087* (2013.01)

(58) Field of Classification Search
CPC ..... B05B 11/056; B05B 11/3087; B05B 11/3094; B05B 11/307; B05B 11/0024; B67D 7/06; A45D 34/00
USPC ..... 141/113, 346–350, 18, 29; 220/89.1; 215/2, 311–315; 137/625.12–625.14
See application file for complete search history.

(56) References Cited

U.S. PATENT DOCUMENTS 2,543,163 A * 2/1951 Greiner ..... 222/481
2,769,457 A * 11/1956 Wittenberg ..... 137/512
2,888,176 A * 5/1959 Miller ..... 222/396
3,559,701 A 2/1971 Wittersheim
3,718,165 A 2/1973 Grothoff
3,768,682 A * 10/1973 Meyers et al. ..... 215/11.5
4,473,097 A 9/1984 Knickerbocker et al.
4,730,744 A * 3/1988 Vinciguerra ..... 215/11.5
4,750,532 A 6/1988 Grothoff
4,828,126 A * 5/1989 Vincinguerra ..... 215/11.5
5,472,112 A * 12/1995 Maciejewski ..... 220/745
5,524,680 A 6/1996 de Laforcade
5,607,074 A * 3/1997 De Gennaro ..... A61J 9/04 215/11.5
5,791,527 A * 8/1998 Giuffredi ..... 222/321.9
6,012,618 A * 1/2000 Matsuo ..... 222/566
6,089,410 A * 7/2000 Ponton ..... B05B 11/0056 222/183
6,435,231 B1 * 8/2002 Cooper et al. ..... 141/346
6,533,482 B1 3/2003 Byun
6,742,665 B2 * 6/2004 Lombardo ..... 215/11.5
6,857,806 B2 2/2005 Harrison et al.
7,249,694 B2 * 7/2007 Masuda ..... 222/212
7,377,296 B2 5/2008 Gueret
7,467,908 B2 * 12/2008 Francavilla et al. ..... 401/278
7,708,035 B2 * 5/2010 Windmiller ..... 141/113

(Continued)

FOREIGN PATENT DOCUMENTS

CN 2114634 9/1992
CN 201055827 5/2008

(Continued)

*Primary Examiner* — Mark A Laurenzi
*Assistant Examiner* — Andrew StClair
(74) *Attorney, Agent, or Firm* — Haugen Law Firm PLLP

(57) ABSTRACT

A refillable perfume atomizer apparatus is described, capable of refill without requiring pouring or exposure of an interior of the liquid storage chamber to the external atmosphere. The perfume atomizer includes an internal pump that creates a negative air pressure within the sealed liquid storage container so that refill liquid is drawn into the liquid storage chamber when the perfume atomizer dispenser is engaged to a refill reservoir container.

17 Claims, 5 Drawing Sheets

(56) References Cited

U.S. PATENT DOCUMENTS

| | | | | |
|---|---|---|---|---|
| 7,850,043 | B2 * | 12/2010 | Foster | 222/1 |
| 8,079,388 | B2 | 12/2011 | Turgeman | |
| 8,197,152 | B2 | 6/2012 | Wu | |
| 8,662,116 | B2 * | 3/2014 | Dumont | B05B 11/0056 141/113 |
| 8,695,896 | B2 * | 4/2014 | Tu | 239/333 |
| 8,915,387 | B2 * | 12/2014 | Kheradvar et al. | 215/11.5 |
| 2004/0112462 | A1 * | 6/2004 | Kelsey et al. | 141/346 |
| 2005/0056343 | A1 | 3/2005 | Gueret | |
| 2005/0089358 | A1 * | 4/2005 | Py et al. | 401/40 |
| 2005/0284891 | A1 * | 12/2005 | Ramet et al. | 222/321.7 |
| 2011/0297275 | A1 * | 12/2011 | Farrar | B05B 11/0043 141/113 |
| 2012/0090730 | A1 * | 4/2012 | Dumont et al. | 141/2 |
| 2012/0090733 | A1 | 4/2012 | Turgeman | |
| 2012/0255647 | A1 * | 10/2012 | Dumont et al. | 141/311 R |
| 2013/0019991 | A1 * | 1/2013 | Muller | 141/18 |
| 2013/0220482 | A1 * | 8/2013 | Fuhrig | 141/18 |
| 2014/0102585 | A1 * | 4/2014 | Lasnier et al. | 141/18 |

FOREIGN PATENT DOCUMENTS

| | | |
|---|---|---|
| EP | 1283180 | 12/2003 |
| FR | 2698341 | 5/1994 |
| FR | 2893598 | 5/2007 |
| GB | 2229380 | 9/1990 |
| JP | 8175578 | 7/1996 |
| JP | 2004182305 | 7/2004 |
| WO | 0243794 | 6/2002 |

* cited by examiner

AUTO REFILL PERFUME ATOMIZER

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to fillable containers. More particularly, the invention pertains to perfume or other cosmetic containers capable of dispensing a fluid that are further capable of refill without requiring pouring or exposure to the external atmosphere.

BACKGROUND

Generally, manual liquid dispensers of various types have been implemented to dispense liquids in a variety of applications. One type of manual liquid dispenser is a dispenser that includes a manually operated nozzle that dispenses a liquid in a fine mist from the dispenser. Such liquid dispensers are commonly referred to as "atomizers", in that the liquid is dispensed in very small liquid droplets. A common application for such atomizer is in the dispensing of fragrant perfumes or other scented liquids.

Other manual liquid dispensers include liquid spray dispensers that utilize a reciprocating handle manually operated by an external force to pump liquid out of a container. When the liquid is pumped under pressure through a spray nozzle, the nozzle generates a dispersed mist of very small liquid droplets. Typically, liquid spray dispensers of this type comprise a pump mechanism that utilize a plunger manually reciprocated in the pump mechanism to draw liquid out of the liquid chamber.

Some of the prior liquid dispensers are intended to be reusable so that a user may re-fill the liquid chamber with replacement liquid. The ability to re-fill the liquid chamber permits re-use of the dispenser and promotes conservation of materials employed in manufacturing the dispenser. A refillable dispenser may also promote the manufacture of more intricate dispensers, both in form and function. One particular example is a reusable fragrant perfume atomizer having an overall size that is suitable for storage in a pocket or small purse. While such small dimensions are useful for portability, the capacity for fragrant perfume is compromised. Thus, it may be beneficial to re-fill the liquid chamber of such small, portable dispensers.

A number of approaches have been implemented for refilling a liquid chamber in a liquid spray dispenser. One approach is to merely open the liquid chamber and pour in the replacement liquid with the use of a funnel. This technique, however, is time-consuming and can result in spillage of the refilling liquid. Another approach is a liquid inlet valve incorporated with the liquid spray dispenser for injecting replacement liquid into the liquid chamber from a pressurized reservoir. The liquid inlet valve is configured for engagement with a dispensing nozzle of a large liquid reservoir. While various designs for connecting inlet valve reservoir systems to liquid spray dispensers have been implemented, conventional designs require a pressurized liquid reservoir or pumping while the inlet valve of the liquid spray dispenser is attached to the larger liquid reservoir. Pumping of the dispenser while attached to a larger liquid reservoir may require added dexterity or may result in potential liquid leakage if the attachment between the dispenser and reservoir fails while pumping.

SUMMARY

Embodiments according to aspects of the invention include a fluid dispenser for dispensing a fragrant perfume, scented liquid, or cosmetic, for example. The dispenser may be refilled from a secondary container without requiring pouring from another container or pumping while attached to another container. The dispenser includes a first fluid reservoir or chamber and second fluid reservoir or chamber formed within the dispenser container. A conduit connects the first and second fluid chambers and includes a passageway that allows exchange of fluids between the first and second fluid chambers.

The dispenser also includes an end plug that is coupled to the container and a user may actuate or move the end plug between a first retracted position and second stowed position. The end plug includes a stem or piston that projects from the end plug and a free end of the stem inserts into the passageway formed by the conduit. The free end of the stem may include a redundant seal that engages to the sidewalls of the passageway and blocks or seals the passageway, thereby restricting the flow of fluid between the first and second fluid chambers. The end plug also includes a valve that couples the plug to the second fluid chamber of the container. When the plug moves between a retracted and stowed position the valve likewise moves in corresponding closed and open positions. A refill port is formed in the end plug and allows the user to transfer fluid into the first fluid chamber through the refill port.

Another embodiment according to aspects of the invention includes a liquid reservoir or chamber partitioned from a second air reservoir or chamber formed within a dispenser or container. A nozzle assembly is coupled to the container in fluid communication with the first fluid chamber and the nozzle assembly is adaptable to dispense fluid from the first fluid chamber through the nozzle assembly. The container includes a conduit that couples the liquid reservoir to the second air reservoir. The conduit has internal walls that define a passageway for air or liquid to pass through between the first and second chambers. An end plug is coupled to the container and a user may move the plug between a first retracted position and second stowed position. The plug includes a stem or piston that has a free end that extends and inserts into the passageway of the conduit. The free end includes o-rings that seal the stem or piston to the internal walls of the passageway so that fluid is restricted from flowing between the first and second chambers. The end plug also includes a valve that couples the plug to the second fluid chamber of the container. When the plug moves between a retracted and stowed position the valve likewise moves between a corresponding closed and open positions. When the valve actuates or is moved to the open position the second fluid chamber of the container and an external atmosphere achieve a pressure equilibrium. Further, when the valve is actuated closed the second fluid chamber of the container is isolated from the external atmosphere.

Another embodiment according to aspects of the invention includes a liquid dispenser apparatus comprising a container that has a liquid reservoir or chamber and a second air reservoir or chamber formed within the container. The chambers are partitioned and a nozzle assembly is coupled to the container in fluid communication with the first fluid chamber. The nozzle assembly is adaptable to dispense fluid from the first fluid chamber through the nozzle assembly. An elongated conduit couples the first fluid chamber and the second fluid chamber and includes a passageway that is in fluid communication between the first and second fluid chambers.

The dispenser also includes an end plug that is coupled to the container and is moveable between a first retracted position and second stowed position. The end plug has a stem or piston projecting from a base of the plug and includes a redundant seal coupled to a free end of the stem or piston. The free end may extend into the conduit and seal against the internal walls of the passageway. When sealed, the fluid communication between the first fluid chamber and the second fluid chamber is blocked. The plug also includes a valve that couples the plug to the second fluid chamber of the container. The valve actuates between an open position and a closed position and is linked to the plug in a manner that when the plug is in a stowed position the valve is in an open position and when the plug is moved to the retracted position the valve actuates to a closed position. When the valve is actuated to an open position the second fluid chamber achieves a pressure equilibrium with an external atmosphere, and when the valve is actuated closed the second fluid chamber is isolated from the external atmosphere. The plug further includes a refill port formed in the plug. The refill port is formed in the plug in a manner so that the port may be coupled to a stem of a refill container.

These and other embodiments according to aspects of the invention include a refillable dispenser that includes a fluid reservoir and a pump assembly in fluid communication with the fluid reservoir. The pump assembly is suitable to reduce the pressure, draw out or evacuate the air sealed within the fluid reservoir. In an embodiment of the invention the dispenser includes a first chamber or fluid reservoir and a second chamber or an evacuation chamber that are coupled together by a passageway. A movable plug or pump is configured so that an amount of air is transferred from the fluid reservoir to the evacuation chamber each time a portion of the plug is retracted from the container. In a particular embodiment, when the plug is in a retracted position a pressure of fluid within the second fluid chamber equalizes with a pressure in the first chamber, but both chambers are isolated from the external atmosphere. As the plug is moved from the retracted position towards the stowed position, the first fluid chamber is sealed from fluid communication with the second chamber and a valve actuates open. When the valve actuates open the second fluid chamber of the container and an external atmosphere achieve pressure equilibrium. In this manner, each time the plug is moved from the stowed to retracted position and back to the stowed position, a pressure within the first fluid chamber is reduced, thereby creating a vacuum within the first fluid chamber. Once a vacuum is created in the first fluid chamber, the dispenser may automatically refill with liquid when the refill port is coupled to a reservoir container.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
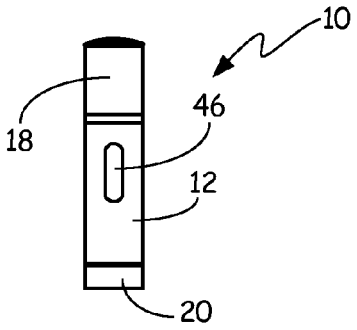
FIG. 1 is a side view of a fluid dispenser in accordance with an embodiment of the invention.
Figure 2:
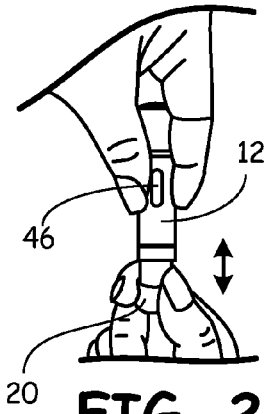
FIG. 2 is a partial perspective view depicting movement of the plug of the fluid dispenser of the type shown in FIG. 1.
Figure 3:
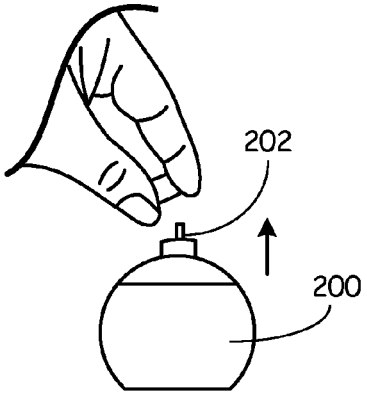
FIG. 3 is a partial perspective view depicting removal of a nozzle from a container.
Figure 4:
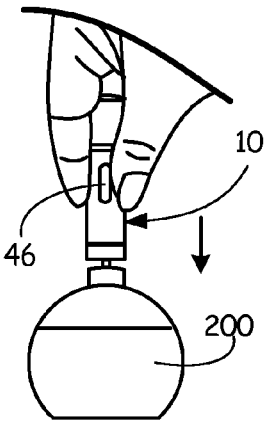
FIG. 4 is a partial perspective view depicting a transfer of fluid from a container of the type shown in FIG. 3 to a fluid dispenser of the type shown in FIG. 2.
Figure 5:
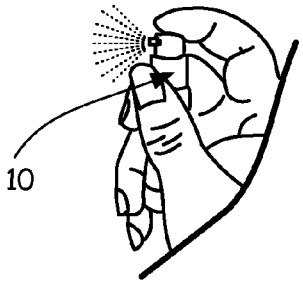
FIG. 5 is a partial perspective view depicting fluid spraying from a fluid dispenser of the type shown in FIG. 4.
Figure 6:
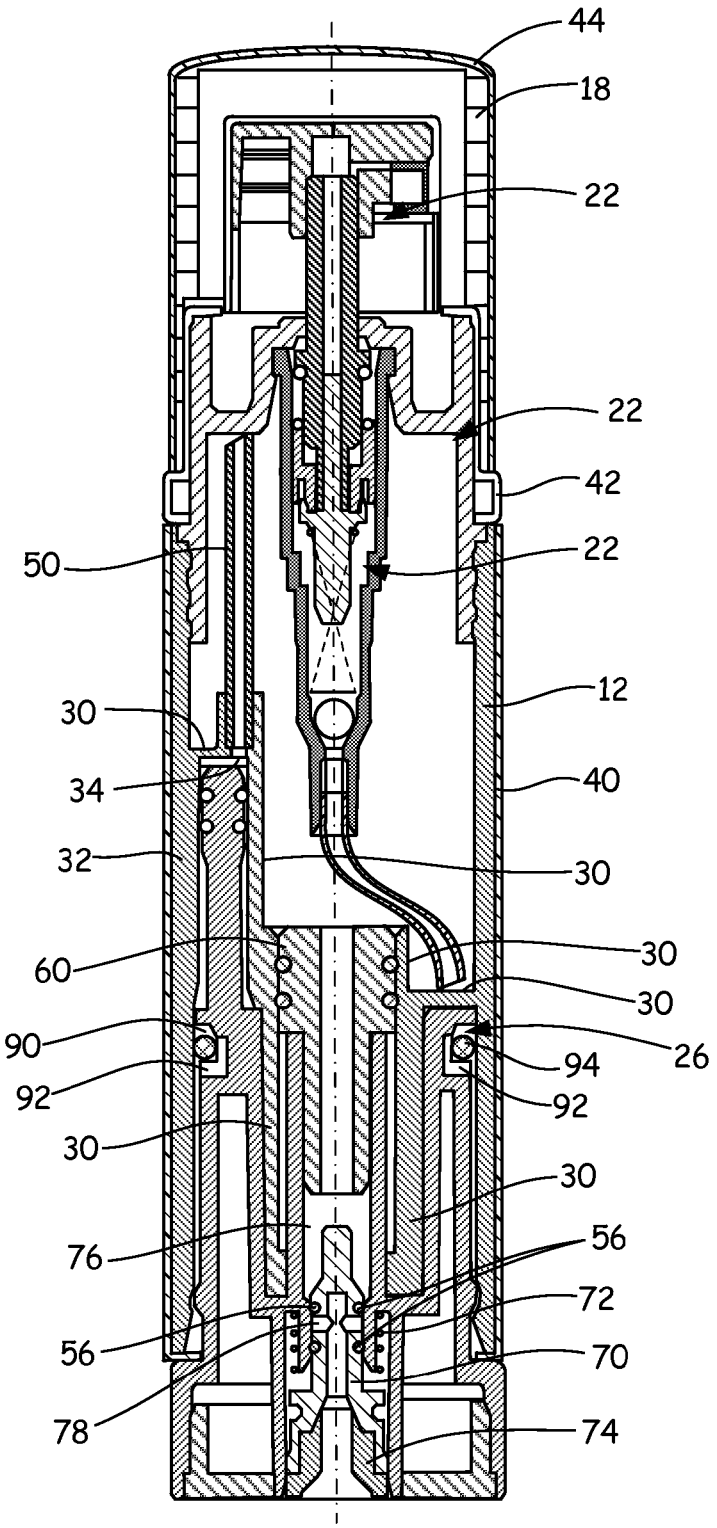
FIG. 6 is a partial sectional view of a fluid dispenser in accordance with an embodiment of the invention, showing the end plug in a stowed position.
Figure 7:
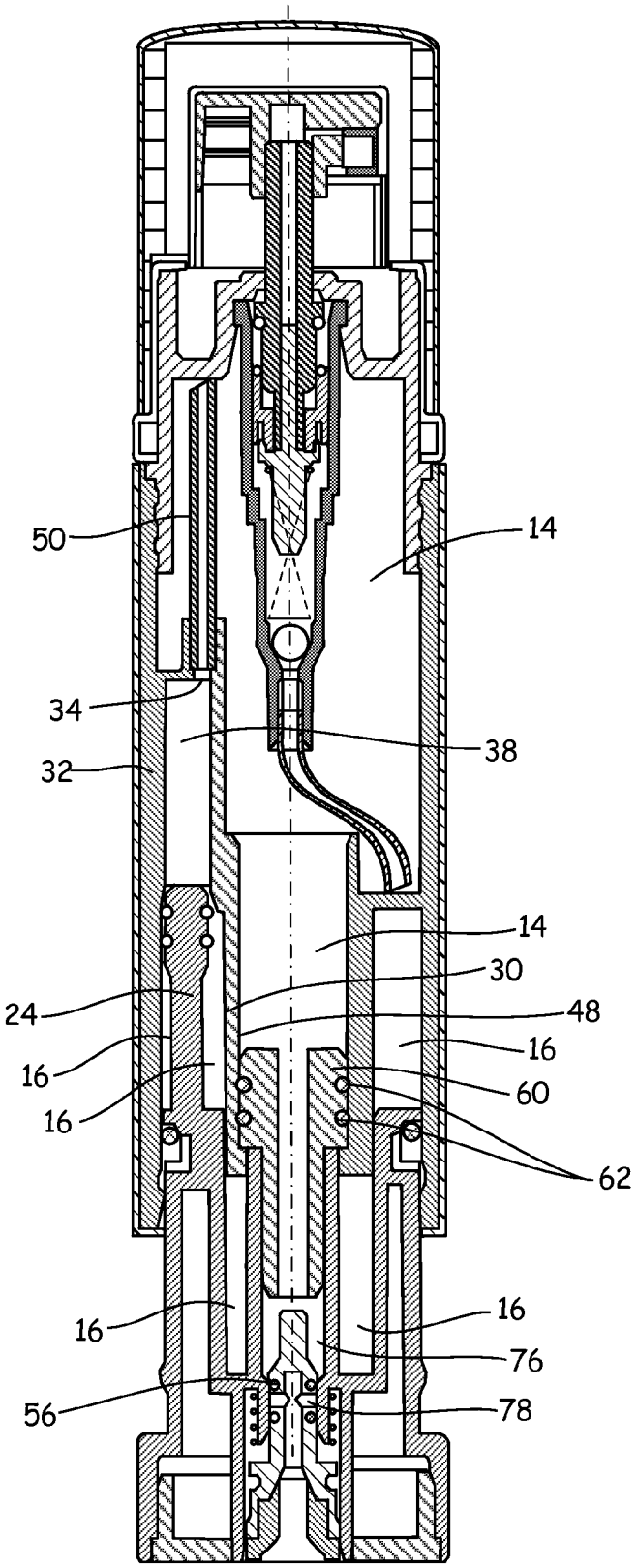
FIG. 7 is a partial sectional view of the fluid dispenser of the type shown in FIG. 6, showing the end plug in a retracted position.
Figure 8:
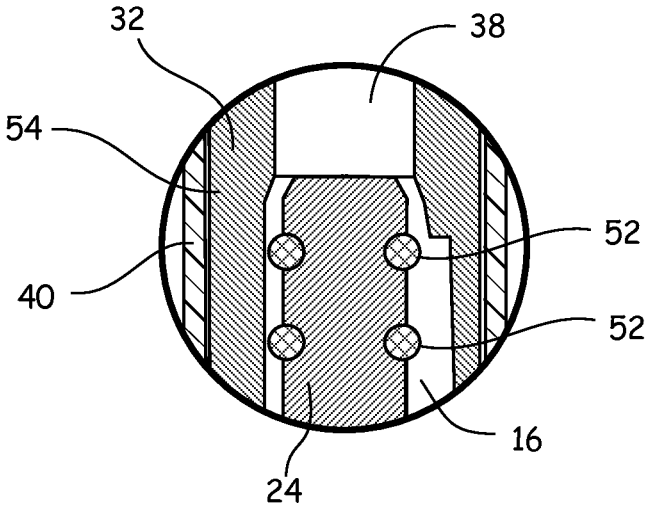
FIG. 8 is a partial sectional view of a portion of a conduit and piston of the fluid dispenser of the type shown in FIG. 6.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The dispenser apparatus of the present invention is particularly well suited as a compact dispenser of perfume and the like. The dispenser includes a chamber for storing a liquid and a nozzle assembly coupled to the storage chamber. The nozzle assembly may be of a known suitable type that dispenses liquid through a spray nozzle in a fine mist or very small liquid droplets. The nozzle may include a check valve of suitable construction that reduces leaking of liquid from the nozzle.

A conduit couples the storage chamber in fluid communication with a second chamber so that an air pressure in the storage chamber may equalize with an air pressure in the second chamber. The second chamber includes a plug that moves within the second chamber between a retracted position and a stowed position. The plug includes a one way valve that actuates between open and closed positions when the plug moves between stowed and retracted positions. The plug also includes a sealing arrangement that blocks or seals the conduit between the two chambers when the valve actuates to an open position. Further, when the valve is in the open position air exchanges from the second chamber to the external environment until air within the second chamber reaches equilibrium with the external environment. The second chamber in conjunction with the movable plug, valve and seals together allow the user to evacuate air from the storage chamber.

In accordance with the present invention a user may evacuate air from the storage chamber 14 prior to refilling liquid in the storage chamber. FIGS. 1-5 illustrate the use of an auto refill dispenser 10 to refill liquid into a storage chamber 14 of the dispenser. A user may reciprocate the end plug 20 between stowed and retracted positions in a pumping like motion (see FIG. 2). In this manner, a pressure within the storage chamber 14 is reduced and a negative pressure is created relative to the external atmosphere. When a user desires to deliver liquid to the storage chamber without exposing the liquid to the external air, and after the negative pressure within the storage chamber 14 is established, the user may uncover the stem 202 of a reservoir or refill container 200 and press or engage the refill port 28 onto the stem 202 of the refill container (see FIGS. 3 and 4). The air pressure within the refill container 200 may approximate atmospheric pressure, but is at least greater than the pressure within the dispenser's storage chamber 14. When the refill port 28 is pressed onto the stem 202 of the refill reservoir 200, both the port 28 of the refill container and a valve within the nozzle assembly of the refill reservoir 200 actuate to open positions and fluid may flow through the port 28 and into the storage chamber 14. The negative pressure within the storage chamber 14 effectively siphons liquid from the refill reservoir 200 until the pressure within the storage chamber 14 and refill reservoir reach equilibrium, or until the storage chamber 14 is full of liquid, or until the user removes the dispenser 10 from the refill reservoir. The user may then spray the liquid from the dispenser (see FIGS. 4 and 5).

Turning attention now to FIGS. 6-10, details of the embodiments of the invention will be further discussed. The dispenser 10 generally includes container 12, cover or cap 18, end or plug 20, and nozzle assembly 22. In an embodiment of the invention the container is made of a translucent material and includes an opaque outer sheath 40. The sheath 40 may include a window or aperture extending through a side of the sheath and aligned with the liquid storage chamber 14, allowing a user to monitor a liquid level within the storage chamber 14. A collar 42 snap fits onto an upper portion of the container and a sheath 44 covers the cap 42. The outer sheaths 40 and 44 and collar 42 may be manufactured from an aluminum or other suitable material and may be coated, plated, textured, or otherwise finished with a desired color and appearance.

The container 12 is generally divided into a liquid storage chamber 14 and second chamber 16 by a partition wall 30. An elongated conduit 32 is formed in the partition wall 30 and includes an aperture 34 extending through an end portion of the conduit 32. The partition is formed in a manner so that conduit 32 extends above a bottom portion of the liquid storage chamber 14. Internal walls 36 of conduit 32 form a passageway 38 between the liquid storage chamber 14 and the second chamber 16. A hollow tube 50 is coupled and sealed around the aperture 34 and extends to a top of the liquid storage chamber 14 (when the container 12 is positioned in an upright orientation with the nozzle assembly 22 aligned above the plug 20 in a vertical orientation as depicted in the Figures). The alignment and extension of the tube 50 within the fluid chamber 14 ensures that only air is drawn from the chamber 14 into the passageway 38 and second chamber 16; the liquid level within the fluid chamber 14 should not rise above the top of the hollow tube 50.

Figure 9:
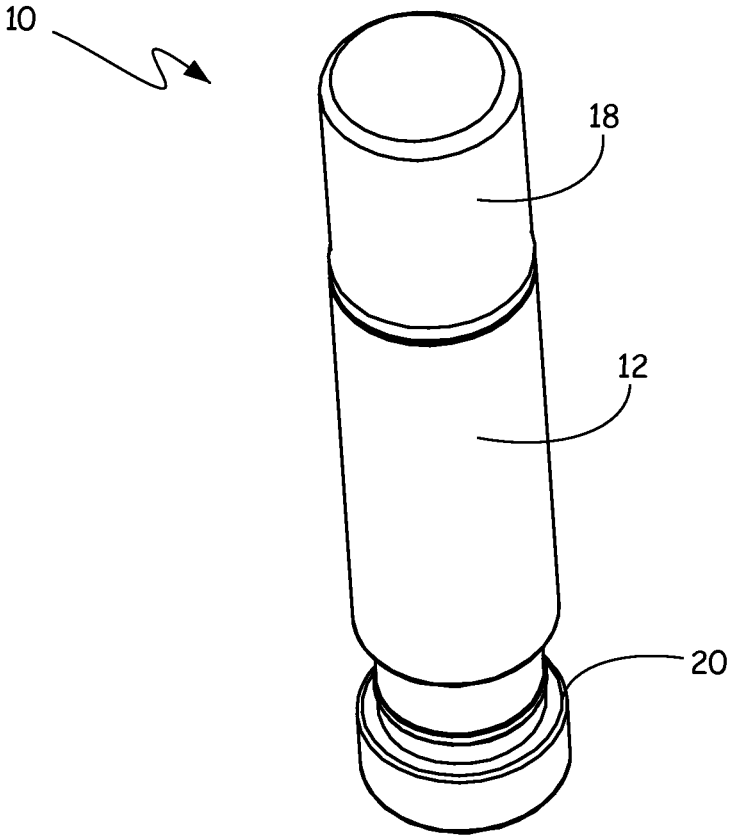
FIG. 9 is a perspective view of a fluid dispenser in accordance with an embodiment of the invention, showing the end plug in a retracted position.
Figure 10:
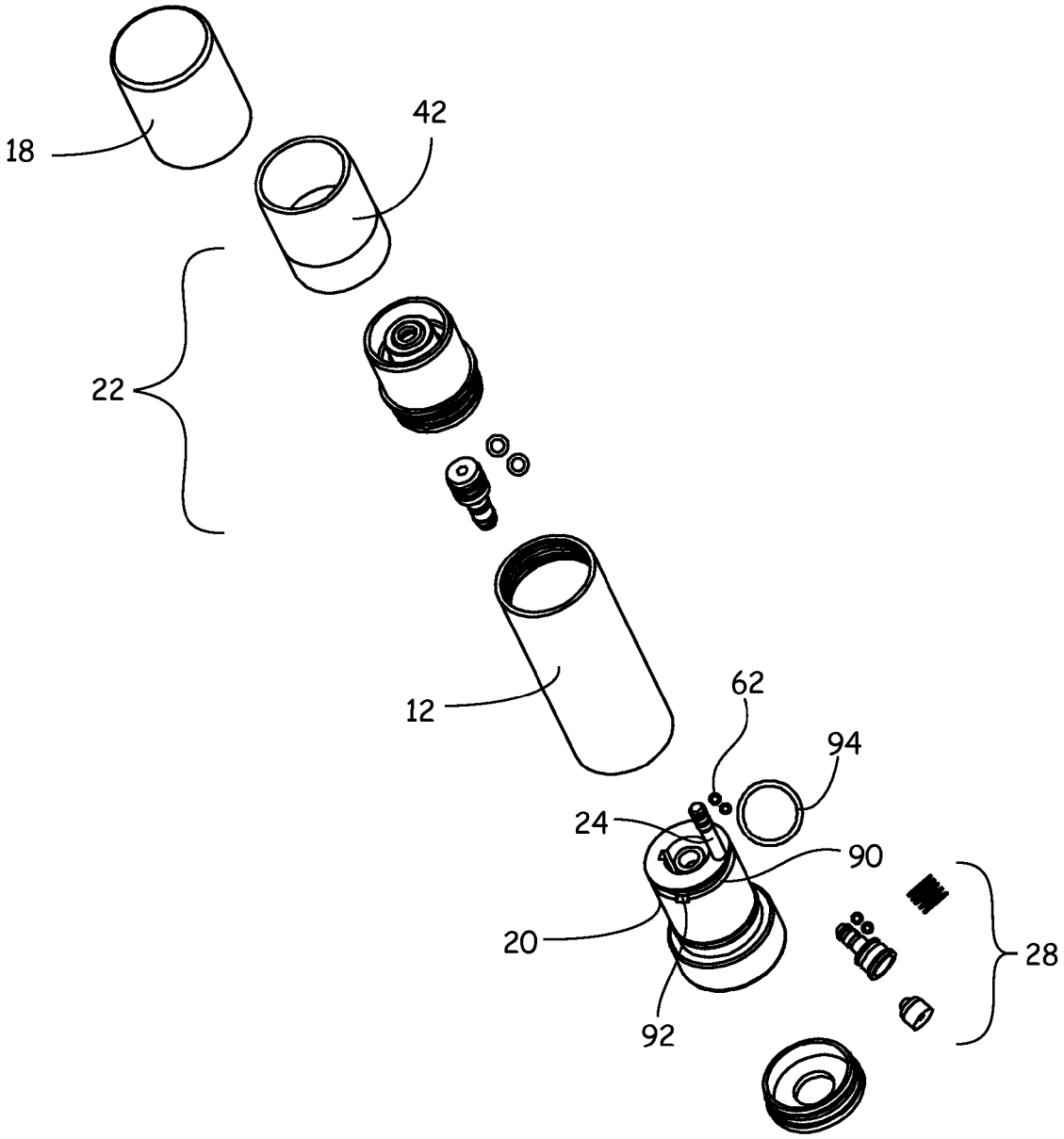
FIG. 10 is an exploded perspective view of components of the fluid dispenser of the type shown in FIG. 9.

The plug 14 generally includes piston or stem 24, valve 26 and refill port assembly 28 (see FIGS. 9 and 10; note that the nozzle assembly 22 is shown exploded and without all of its component parts). The piston or stem 24 extends upward from an upper end of the plug and includes redundant sealing rings or o-rings 52 aligned near a free end or an upper end of the piston or stem 24. When the plug 20 is inserted into the second chamber 16 of the container 12 and situated in its stowed position, piston or stem 24 extends into the conduit 32. An end of the conduit 32 is tapered to facilitate insertion of the piston or stem 24 into the conduit 32. Sealing rings 52 engage with the sidewalls 36 of the conduit 32 to thereby block fluid from exchanging between the first chamber 14 and second chamber 16 through passageway 38. When the plug 20 is retracted from the container 12, sealing rings 52 disengage from the sidewalls and air may pass between the first chamber 14 and second chamber 16 through passageway 38 (see FIG. 8). Partition wall 30 includes an elongated portion through which a bore 48 extends. The bore 48 extends through the partition creating a channel between the first chamber 14 and second chamber 16. The bore sidewalls 48 narrow to a smaller bore diameter near a bottom of the partition. Plug 20 also includes a stop 60 that slides within the channel of the bore. The stop 60 includes a redundant seal 62 that seals against the bore sidewalls and restricts liquid from passing past the stop into the second chamber 16. When the plug 20 is in the fully retracted position the stop 60 rests against the bottom of the partition 30 restricting further retraction of the plug 20. Plug 20 further includes an aperture extending through the plug to allow passage of liquid between the first fluid chamber 14 and refill port 28.

The refill port assembly 28 is of a suitable self-sealing construction and may, for example, include a needle valve 70, compression spring 72, expandable inlet 74, and seals 56. When a nozzle stem 202 of reservoir container 200 is pressed into the expandable inlet 74, the spring 72 compresses and a tip of needle valve 70 extends into a cavity 76 of plug 20. The needle valve 70 includes a groove 78 formed in the valve body such that when the tip of the needle valve extends into the cavity 76, the groove 78 allows fluid communication between the inlet 74 and first fluid chamber 14.

The plug 20 also includes the annular one way valve 26 formed near an upper end of the plug. The valve 26 includes an annular groove 90, slots 92 (see FIGS. 6 and 10) and seal 94. The groove and seal 94 are sized to allow the seal to move in the groove between an open and closed position, such that the valve is actuatable between and open and closed position. When the plug is moved to the retracted position the seal actuates in the groove to the closed position and when the plug is moved to the stowed position the seal actuates in the groove to the open position. The seal 94 seals against groove 90 and the inner wall of the chamber 16 of the container 12. The diameter of the plug body 20 is sized smaller than the internal diameter of chamber 16 of the container 12 so that a portion of the plug body is exposed to air external to the container. When in the closed position, the seal 94 blocks fluid from passing between the second chamber 16 and the slot 92 (see FIG. 7). When the seal 94 moves in the groove 90 to the open position (FIG. 6), air exchanges through the slot 92 between the chamber 16 and air external to the container 12.

When the plug 20 is moved to the stowed position, a free end of the piston or stem 24 extends into the conduit 32 and seals against the internal walls 36 of the passageway 38 such that when the free end extends into the conduit and seals against the internal walls of the passageway, fluid communication between the first fluid chamber and the second fluid chamber is blocked. Likewise, when the plug 20 is moved between the retracted and stowed positions the valve 26 actuates between an open position and a closed position. When the valve 26 is actuated to an open position the second fluid chamber 16 of the container 12 and an external atmosphere achieve a pressure equilibrium. When the valve 26 is actuated closed the second fluid chamber 16 of the container 12 is isolated from the external atmosphere.

Further, when the end plug 20 is moved to the retracted position the valve 26 is in the closed position and the piston 24 does not seal against the internal walls 36 of the passageway 38. When the end plug 20 is moved to the second stowed position the valve 26 is in the open position and the piston 24 seals against the internal walls 36 of the passageway 38. The piston 24 may include a redundant seal on a free end of the piston to further ensure an air tight seal between the piston 24 and the internal walls 36 of the passageway 38. Also, when the end plug 20 is moved to the second stowed position the end plug extends into the second fluid chamber.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A fluid dispenser apparatus comprising:

a container having a partition wall that divides said container into an enclosed first fluid chamber and a second fluid chamber;

a conduit formed in said partition wall of said container coupling said first fluid chamber and said second fluid chamber, said conduit having internal walls defining a passageway in fluid communication between said first fluid chamber and said second fluid chamber;

a plug coupled to said container and at least a portion of said plug positioned in said second fluid chamber, said plug adapted for moving between a retracted position and a stowed position; said plug having a stem projecting from said plug;

said stem including a free end extendable into said conduit and sealable against said internal walls of said passageway;

a valve engaged to said plug and coupling said plug and said second fluid chamber of said container, said valve actuatable between an open position and a closed position; and a refill port in said plug and coupled in fluid communication with said first fluid chamber, wherein when said plug is moved to the retracted position said valve actuates to said closed position and said stem does not seal against said internal walls of said passageway; and wherein when said plug is moved to the stowed position said valve actuates to said open position and said stem seals against said internal walls of said passageway.

2. The apparatus as recited in claim 1, wherein a pressure of a fluid in the second fluid chamber equalizes with a pressure in the external atmosphere when said valve is actuated to the open position.

3. The apparatus as recited in claim 1, wherein when said valve is actuated to an open position said second fluid chamber of said container and an external atmosphere achieve a pressure equilibrium, and when said valve is actuated closed said second fluid chamber of said container is isolated from the external atmosphere.

4. The apparatus as recited in claim 1, said free end of said stem further including a redundant seal.

5. The apparatus as recited in claim 1, wherein said plug extends into said second fluid chamber when said plug is moved to said stowed position.

6. The apparatus as recited in claim 1, wherein a pressure of a fluid within said first fluid chamber decreases when said plug is moved to the retracted position from the stowed position.

7. The apparatus as recited in claim 1, further including a stop that restricts said plug from moving beyond the retracted position and further away from the stowed position.

8. The apparatus as recited in claim 1, wherein said conduit is elongated and extends into a portion of said first fluid chamber.

9. A fluid dispenser apparatus comprising:

a single unitary container having first and second fluid chambers defined by outer walls of said container and having a partition that separates said first and second fluid chambers within said container;

a nozzle assembly in fluid communication with said first fluid chamber, said nozzle assembly adaptable to dispense fluid from said first fluid chamber through said nozzle assembly;

a conduit coupling said first fluid chamber and said second fluid chamber, said conduit having internal walls defining a passageway in fluid communication between said first fluid chamber and said second fluid chamber;

an end plug slidingly engaged to said container and moveable between a retracted position and a stowed position; said end plug having a piston projecting from said end plug;

said piston including a free end extendable into said conduit and sealable against said internal walls of said passageway such that when said free end extends into said conduit and seals against said internal walls of said passageway, fluid communication between said first fluid chamber and said second fluid chamber is blocked; and a valve slidingly engaged to said end plug and coupling said end plug and said second fluid chamber of said container, said valve actuatable between an open position and a closed position, wherein when said valve is actuated to an open position said second fluid chamber of said container and an external atmosphere achieve a pressure equilibrium, and when said valve is actuated closed said second fluid chamber of said container is isolated from the external atmosphere, wherein when said end plug is moved to the retracted position said valve is in said closed position and said piston does not seal against said internal walls of said passageway; and wherein when said end plug is moved to the stowed position said valve is in said open position and said piston seals against said internal walls of said passageway.

10. The apparatus as recited in claim 9, further including a refill port formed in said end plug and coupled in fluid communication with said first fluid chamber.

11. The apparatus as recited in claim 9, said piston free end further including a redundant seal.

12. The apparatus as recited in claim 9, wherein said end plug extends into said second fluid chamber when said end plug is moved to said stowed position.

13. The apparatus as recited in claim 9, further including a stop that restricts said end plug from moving beyond the retracted position.

14. The apparatus as recited in claim 9, wherein said conduit is elongated and extends into a portion of said first fluid chamber.

15. A fluid dispenser apparatus comprising:

a container having first and second fluid chambers, said first and second fluid chambers sharing a common continuous sidewall of said container and said container having a partition that separates said first and second fluid chambers;

a nozzle assembly in fluid communication with said first fluid chamber, said nozzle assembly adaptable to dispense fluid from said first fluid chamber through said nozzle assembly;

an elongated conduit coupling said first fluid chamber and said second fluid chamber, said conduit having internal walls defining a passageway in fluid communication between said first fluid chamber and said second fluid chamber, wherein said conduit extends into said first fluid chamber;

an end plug coupled to said container and moveable between a retracted position and a stowed position; said end plug having a piston projecting from said end plug;

said piston including a redundant seal coupled to a free end of said piston, said free end extendable into said conduit and sealable against said internal walls of said passageway such that when said free end extends into said conduit and seals against said internal walls of said passageway, the fluid communication between said first fluid chamber and said second fluid chamber is blocked;

a valve slidingly engaged to said end plug and coupling said end plug and said second fluid chamber of said container, said valve actuatable between an open position and a closed position, wherein when said valve is actuated to an open position said second fluid chamber of said container and an external atmosphere achieve a pressure equilibrium, and when said valve is actuated closed said second fluid chamber of said container is isolated from the external atmosphere;

a refill port formed in said end plug and coupled in fluid communication with said first fluid chamber;

a stop that restricts said end plug from moving beyond the retracted position, wherein when said end plug is moved to the retracted position said valve is in said closed position and said piston does not seal against said internal walls of said passage; and wherein when said end plug is moved to the stowed position said valve is in said open position and said piston seals against said internal walls of said passageway.

16. The apparatus as recited in claim 15, wherein said end plug extends into said second fluid chamber when said end plug is moved to said stowed position.

17. The apparatus as recited in claim 16, wherein a capacity to retain fluid within said passageway decreases as said end plug is moved to the second stowed position.

* * * * *